US006405764B1

(12) United States Patent
Wang

(10) Patent No.: US 6,405,764 B1
(45) Date of Patent: Jun. 18, 2002

(54) SYSTEM AND METHOD FOR PACKAGING OF BEVERAGES IN CONTAINERS AT CONTROLLED TEMPERATURES

(75) Inventor: James J. Wang, Sugar Land, TX (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/788,610

(22) Filed: Feb. 21, 2001

(51) Int. Cl.[7] ..... B65B 1/04

(52) U.S. Cl. ..... 141/12; 141/10; 141/82; 141/83; 141/100

(58) Field of Search ..... 141/10, 12, 82, 141/83, 100, 103; 222/129.1, 129.3, 129.4, 146.1, 146.2, 146.6; 53/127

(56) References Cited

U.S. PATENT DOCUMENTS

| | | | | |
|---|---|---|---|---|
| 3,738,080 | A | 6/1973 | Reil | 53/180 |
| 3,911,642 | A | 10/1975 | Ernstsson et al. | 53/28 |
| 4,069,153 | A | 1/1978 | Gunther | 210/64 |
| 4,121,107 | A | 10/1978 | Bachmann | 250/455 |
| 4,255,383 | A | 3/1981 | Schenck | 422/24 |
| 4,289,728 | A | 9/1981 | Peel et al. | 422/24 |
| 4,366,125 | A | 12/1982 | Kodera et al. | 422/295 |
| 4,375,145 | A | 3/1983 | Mosse et al. | 53/425 |
| 4,448,750 | A | 5/1984 | Fuesting | 422/20 |
| 4,590,740 | A | 5/1986 | Rodocker | 53/426 |

(List continued on next page.)

FOREIGN PATENT DOCUMENTS

| | | |
|---|---|---|
| WO | WO 92/18170 | 10/1992 |
| WO | WO 98/40273 | 9/1998 |
| WO | WO 99/08932 | 2/1999 |
| WO | WO 99/08934 | 2/1999 |
| WO | WO 00/00394 | 1/2000 |
| WO | WO 00/15539 | 3/2000 |

OTHER PUBLICATIONS

Naito Shigezo et al., Method and Device for Sterilizing Packing Material, Abstract of JP 05178334, Jul. 20, 1993.

Ota Toshiyuki et al., Ozone Sterilization Method for Aqueous Solution System, Abstract of JP 06226273, Aug. 16, 1994.

Dainippon Printing, Derwent Abstract of JP 09240629, Sep. 16, 1997.

Naito Akira et al., Bathing Water Circulating and Filtering System, Abstract of JP 09285413, Nov. 4, 1997.

Hirashiki Isamu et al., Sterilizing Method and Apparatus, Abstract of JP 11226579, Aug. 24, 1999.

Fukuda Masahiko et al., Apparatus for Sterilization by Ultra Violet Radiation, Abstract of JP 11319817, Nov. 24, 1999.

Murao Kazunori et al., Process and Device for Sterilization, Abstract of JP 11342919, Dec. 14, 1999.

Kitada Takuya et al., Method and Device for Sterilization of Packaging–Material, Abstract of JP 2000142641, May 23, 2000.

*Primary Examiner*—Timothy L. Maust
*Assistant Examiner*—Peter deVore
(74) *Attorney, Agent, or Firm*—Finnegan, Henderson, Farabow, Garrett & Dunner, L.L.P.

(57) ABSTRACT

A method and system for packaging hot beverages in flexible aseptic pouches includes filling the pouches with a hot beverage concentrate, immediately thereafter filling the pouches with chilled sterile water in order to lower the temperature of the resulting mixture of concentrate and water in the pouches, sealing the pouches, and transporting the pouches directly to a bundler or multi-pac assembling device. The method and system does not require the use of a separate cooling station for the hot pouches between the filler and bundler due to the introduction of chilled sterile water into the pouches at the outset, as part of a two-stage filling process. Containers of other types than flexible packages may also be filled by the method and system.

24 Claims, 2 Drawing Sheets

U.S. PATENT DOCUMENTS

| | | | | | |
|---|---|---|---|---|---|
| 4,656,813 | A | | 4/1987 | Baldini et al. | 53/410 |
| 4,674,657 | A | * | 6/1987 | Daniels | 222/129.4 |
| 4,797,255 | A | | 1/1989 | Hatanaka et al. | 422/28 |
| 4,809,485 | A | | 3/1989 | Nielsen | 53/503 |
| 4,848,063 | A | | 7/1989 | Niske | 53/451 |
| 4,896,768 | A | | 1/1990 | Anderson | 206/210 |
| 4,910,942 | A | | 3/1990 | Dunn et al. | 53/425 |
| 5,047,072 | A | | 9/1991 | Wertz et al. | 55/1 |
| 5,073,268 | A | | 12/1991 | Saito et al. | 210/638 |
| 5,114,670 | A | | 5/1992 | Duffey | 422/24 |
| 5,122,340 | A | | 6/1992 | Shimamura et al. | 422/28 |
| 5,129,212 | A | | 7/1992 | Duffey et al. | 53/426 |
| 5,135,714 | A | | 8/1992 | Wang | 422/23 |
| 5,144,670 | A | | 9/1992 | Negishi | 381/24 |
| 5,155,980 | A | | 10/1992 | Mansson et al. | 53/551 |
| 5,158,816 | A | | 10/1992 | Rausing | 428/35.8 |
| 5,213,759 | A | | 5/1993 | Castberg et al. | 422/24 |
| 5,326,542 | A | | 7/1994 | Sizer et al. | 422/291 |
| 5,348,665 | A | | 9/1994 | Schulte et al. | 210/748 |
| 5,350,568 | A | | 9/1994 | Tuckner et al. | 422/300 |
| 5,428,078 | A | | 6/1995 | Cohen et al. | 522/2 |
| 5,433,920 | A | | 7/1995 | Sizer et al. | 422/24 |
| 5,445,793 | A | | 8/1995 | Tuckner et al. | 422/28 |
| 5,489,022 | A | | 2/1996 | Baker | 206/439 |
| 5,494,691 | A | | 2/1996 | Sizer | 426/392 |
| 5,730,934 | A | | 3/1998 | Holbert | 422/24 |
| 5,843,374 | A | | 12/1998 | Sizer et al. | 422/24 |
| 5,947,334 | A | * | 9/1999 | Rudick et al. | 222/129.2 |
| 6,039,922 | A | | 3/2000 | Swank et al. | 422/24 |
| 6,056,918 | A | | 5/2000 | Palaniappan et al. | 422/24 |
| 6,094,887 | A | | 8/2000 | Swank et al. | 53/426 |
| 6,120,730 | A | | 9/2000 | Palaniappan et al. | 422/28 |
| 6,183,691 | B1 | | 2/2001 | Swank et al. | 422/24 |

* cited by examiner

SYSTEM AND METHOD FOR PACKAGING OF BEVERAGES IN CONTAINERS AT CONTROLLED TEMPERATURES

BACKGROUND OF THE INVENTION

1. Field of the Invention

The present invention relates to a method and system for the packaging of beverages in containers at controlled temperatures. More specifically, the present invention relates to a method and system for rapidly filling containers such as flexible pouches with hot sterile juices in an automated process, and forming multi-pac packages of bundled pouches, without use of a separate cooling apparatus in the assembly line.

2. Description of Background Art

Filling of hot, sterile beverages into containers of any type; plastic, glass or metal, conventionally requires the use of a separate cooling station in the assembly line. These cooling stations are rather massive, having footprints of about five (5) by twenty (20 feet, and heights of six (6) to eight (8) feet. In addition, these coolers lower system throughput and efficiency. Furthermore, these coolers consume large amounts of energy to operate.

Heretofore, systems have been known for making and filling flexible pouches with hot pasteurized beverages such as juices in an assembly line, which ultimately bundle the flexible pouches into secondary packages, multi-pac packages such as six-packs, twelve-packs, or the like. In these conventional systems, the beverage to be filled into the flexible pouches is pasteurized by heating the beverage to a high temperature in the range of about 185° F. These pasteurized beverages typically include a mixture of flavor concentrate and a diluent such as water. In these systems, the entire mixture of the water and juice concentrate is heated prior to filling the pouches at this high temperature. Therefore, once the flexible pouches are filled with this very hot beverage, it is necessary in the package-producing assembly line to pass the filled pouches through a cooling station to lower the temperature of these pouches to a temperature that can be effectively handled by the bundling and/or packaging machines. However, a cooling station of this type takes up a considerable amount of space and footprint area in the packaging factory, is expensive to operate, and slows down the overall processing rate.

Accordingly, there is a need in the art for a process and system for filling and manufacturing flexible-pouch, aseptic containers, or other types of containers in a more rapid fashion than heretofore possible at a lower cost, and with a much smaller overall footprint of the assembly line.

SUMMARY OF THE INVENTION

According to one aspect of the invention, a method for sterile packaging of beverages includes supplying a predetermined quantity of a beverage concentrate at a first predetermined temperature to a container such as a flexible pouch and, immediately thereafter, filling the container or pouch with a sterile, chilled, diluent such as water at a second predetermined temperature which is much lower than the first predetermined temperature. The resulting mixture of the concentrate and diluent is thereby cooled to a third predetermined temperature. The method also includes sealing the container to form a sterile package of beverage.

The present invention described herein is described with containers in the form of sterile flexible packages as a preferred embodiment, but use of the system and method of the present invention is also advantageous for filling of containers of any type.

According to another aspect of the invention, a system for sterile packaging of beverages includes a first filling device for supplying a predetermined quantity of a beverage concentrate at a first predetermined temperature to a container and a second filling device for immediately thereafter filling the container with a sterile, chilled, diluent at a second predetermined temperature which is much lower than the first predetermined temperature. The mixture of the concentrate and diluent is thereby cooled to a third predetermined temperature. The system also includes a mechanism for sealing the container to form a sterile package of beverage.

In a preferred embodiment, the first predetermined temperature of the beverage concentrate is about 185° F., the temperature of the chilled diluent is about 35° F., and the third predetermined temperature of the mixture of concentrate and diluent adjusts to about 100° F. for equal volumes of concentrate and diluent. By lowering the temperature to about 100° F., the packaging equipment in the assembly line can effectively handle the filled beverage pouches and bundle them into multi-pac packages without damaging the pouches. This is accomplished without the addition of a separate cooling station such as used in the prior art, which takes up a substantial amount of space, adds to the overall expense of the packaging assembly line, slows down the system throughput, and consumes large amounts of energy.

The overall assembly line may include, in addition, a station for adding a straw to the flexible package, a die-cutting station for separating a web of a plurality of flexible pouches into individual pouches following the filling thereof, marking the packages with identifying data such as dates; a weighing station for weighing the pouches to be sure that they have been properly filled; and a high-speed pick-and-place case-erecting, packing and closing machine at the end of the assembly line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENTS

Figure 1:
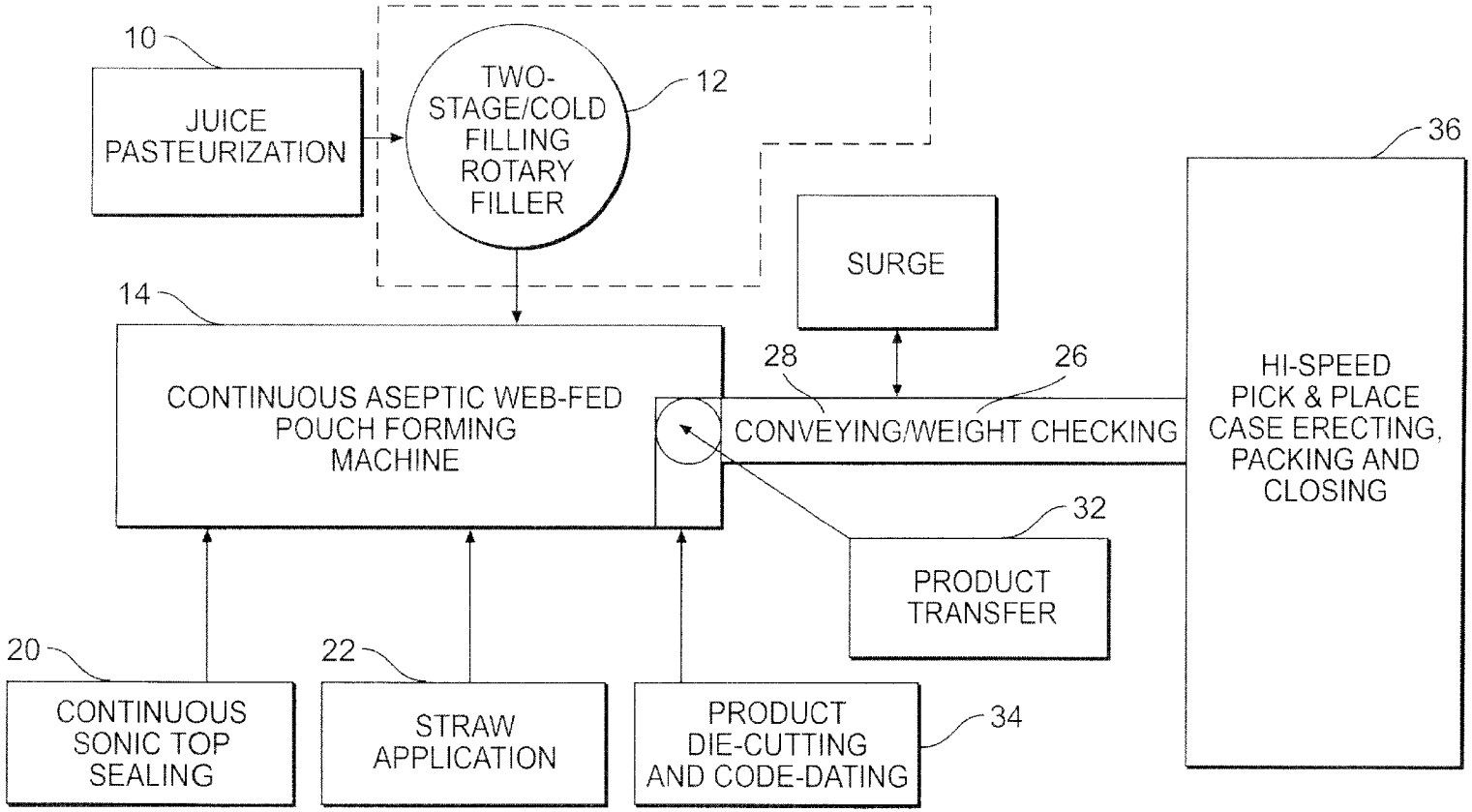
FIG. 1 is a schematic block diagram depicting the overall system configuration of the present invention.
Figure 2:
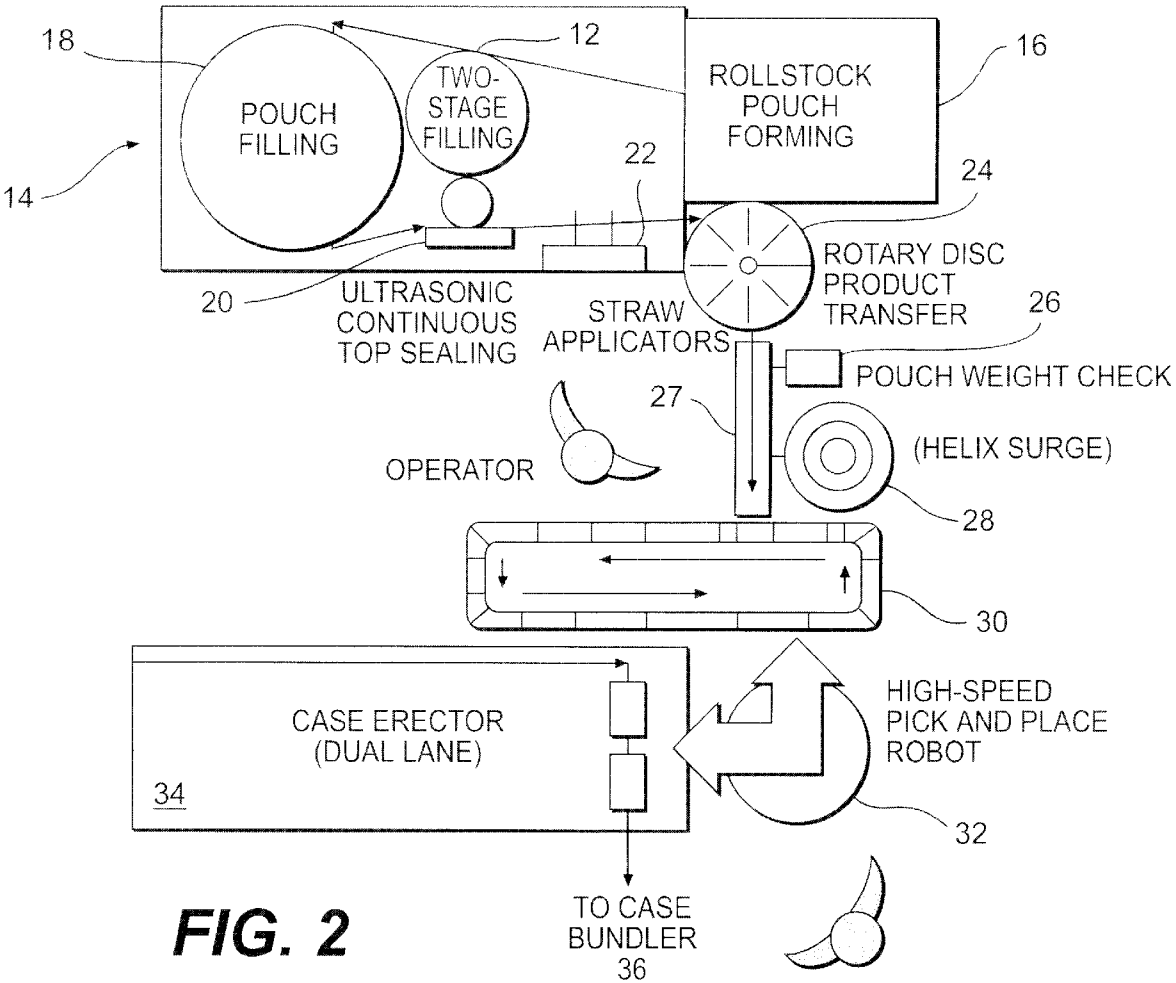
FIG. 2 is a schematic diagram of the pouch forming and filling portion of the system of FIG. 1 depicted in more detail.

Referring in detail to the drawings, a method and system for rapidly filling flexible pouches with hot beverages is generally illustrated. A juice pasteurization device 10 is provided for heating juice concentrate to a temperature high enough to pasteurize the concentrate and deliver it to a rotary filling station 12. The juice concentrate may vary in composition. For example, it may be a flavor concentrate combined with sugar, or may be a natural juice concentrate such as orange juice, which is used to form the final consumable beverage by mixing with a liquid such as water.

In accordance with the present invention, the flexible packages to be filled are formed in a pouch-forming machine 14, which may be any commercially available type of machine providing a pouch output of approximately 600 ppm. The pouches formed before sealing are filled in a two-stage filling process, first from hot concentrate dispensed from juice pasteurization device 10 into the pouch, and secondly from a chilled sterile water source. The hot juice concentrate dispensed from juice pasteurization device 10 enters the filling machine and pouch (or any other type of container) to be filled at about 185° F. Chilled water, which has been sterilized is introduced to the filler 12, and then into the pouches being made within pouch forming machine 14 at approximately 35° F. The resulting mixture of hot concentrate and chilled water quickly reaches a temperature of approximately 100° F. It is desirable to lower the temperature of the filled packages to about this temperature because at elevated temperatures above 100° F., the flexible package may be in a soft and tacky state, and may be easily damaged by the bundling and packing machines. However, with the two-stage filling process of the present invention, the packages are cooled down to approximately 100° F., and can be handled with conventional conveying and handling equipment for assembly into multi-pac packages without damage to the flexible pouches.

Preferably, the pouch forming machine 14 receives a folded sheet of a plastic web from roll stock pouch forming machine 16, and divides sections of the web into individual flexible pouches for filling from the liquid filling machine 12. Preferably, the pouch forming machine, in conjunction with the filling machine 12, can make and form filled packages rapidly on a continuous basis at a rate of about 600 ppm for 200 ml pouches, or 300 ppm for 330 ml pouches of various desired shapes and characteristics.

The pouches, once filled, are sealed along the fill opening thereof by a continuous sonic sealing device 20. Drinking straws may be inserted into the pouches, or attached thereto through the use of a known type of straw application device 22. Pouches from the roll stock are separated into individual containers through the use of a die-cutting device 34, which may also be provided with a printer for coding the packages with information such as the date of manufacture. Also provided at the output of the package forming and filling machinery is a rotary disc product transfer device 24 which supplies individual packages to a conveyor 27 for passing through a pouch weight checking device 26, which determines if the pouch has been properly filled. The pouches then move through a helix surge device 28 to a conveyor system 30. A high-speed pick-and-place robot 32 transfers packages from the conveyor 30 onto a dual-lane case erector 34. The packages within the dual lanes are then transported to a case bundler 36. Details of the aforementioned subassemblies for handling and processing the flexible pouches after manufacture and filling are not part of the present invention. The multi-pacs may be six-packs, twelve-packs, or any desired number.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for sterile packaging of beverages comprising the steps of:

a) supplying a predetermined quantity of a beverage concentrate at a first predetermined temperature to a container, said first predetermined temperature being high enough to pasteurize the beverage concentrate and soften materials forming the container;

b) immediately thereafter filling the container with a sterile diluent at a second predetermined temperature which is much lower than said first predetermined temperature to thereby cool a mixture of the concentrate and diluent to a third predetermined temperature, said third predetermined temperature being below temperatures which would soften the materials; and c) sealing the container to form a sterile package of beverage.

2. The method of claim 1, wherein said first predetermined temperature is about 185° F., said second predetermined temperature is about 35° F., and said third predetermined temperature is less than 100° F. for equal quantities of concentrate and diluent.

3. The method of claim 2, wherein said concentrate is a hot juice concentrate and said diluent is water.

4. The method of claim 2, wherein said container is a flexible pouch.

5. The method of claim 4, further comprising the step of attaching a drinking stray to the flexible pouch after the step of sealing.

6. The method of claim 4, further comprising the step of weighing the filled container after sealing thereof.

7. The method of claim 1, wherein said concentrate is a hot juice concentrate and said diluent is water.

8. The method of claim 1, wherein said container is a flexible pouch.

9. The method of claim 1, including the further steps of:

transporting the container with the mixture of concentrate and diluent at said third predetermined temperature directly to a packer forming multi-pacs of the containers filled with beverages without performing any further active cooling steps.

10. The method of claim 1, further comprising the step of attaching a drinking straw to the container after sealing the container.

11. The method of claim 1, further comprising the step of weighing the filled container after sealing thereof.

12. The method of claim 1, wherein both filling steps are performed in a sterile environment.

13. A system for sterile packaging of beverages comprising:

a) a first filling device for supplying a predetermined quantity of a beverage concentrate at a first predetermined temperature to a container, said first predetermined temperature being high enough to pasteurize the beverage concentrate and soften materials forming the container;

b) a second filling device for immediately thereafter filling the container with a sterile diluent at a second predetermined temperature which is much lower than said first predetermined temperature to thereby cool a mixture of the concentrate and diluent to a third predetermined temperature, said third predetermined temperature being below temperatures which would soften the materials; and c) a mechanism for sealing the container to form a sterile package of beverage.

14. The system of claim 13, wherein said first predetermined temperature is about 185° F., said second predetermined temperature is about 35° F., and said third predetermined temperature is less than 100° F. for equal quantities of concentrate and diluent.

15. The system of claim 14, wherein said concentrate is a hot juice concentrate and said diluent is water.

16. The system of claim 14, wherein said container is a flexible pouch.

17. The system of claim 16, further comprising a device attaching a drinking straw to the flexible pouch after the step of sealing.

18. The system of claim 16, further comprising a scale for weighing the filled container after sealing thereof.

19. The system of claim 13, wherein said concentrate is a hot juice concentrate and said diluent is water.

20. The system of claim 13, wherein said container is a flexible pouch.

21. The system of claim 13, further comprising:

a conveyor for transporting the container with the mixture of concentrate and diluent at said third predetermined temperature directly to a packer forming multi-pacs of the containers filled with beverages without performing any further active cooling steps.

22. The system of claim 13, further comprising a device for attaching a drinking straw to the container after sealing the container.

23. The system of claim 13, further comprising a scale for weighing the filled container after sealing thereof.

24. The system of claim 13, wherein filling of the container is performed in a sterile environment.

* * * * *

UNITED STATES PATENT AND TRADEMARK OFFICE

CERTIFICATE OF CORRECTION

PATENT NO. : 6,405,764 B1
DATED : June 18, 2002
INVENTOR(S) : James J. Wang

It is certified that error appears in the above-identified patent and that said Letters Patent is hereby corrected as shown below:

Column 4,
Line 28, “stray” should read -- straw --.

Signed and Sealed this

Twentieth Day of August, 2002

*Attest:*

*Attesting Officer*

JAMES E. ROGAN
*Director of the United States Patent and Trademark Office*